United States Patent [19]

Liga

[11] 3,958,775

[45] May 25, 1976

[54] INTERLOCKING CARDBOARD SPOOL ASSEMBLY

[75] Inventor: Donald J. Liga, Youngstown, Ohio

[73] Assignee: Kessler Products Co., Inc., Youngstown, Ohio

[22] Filed: Feb. 6, 1975

[21] Appl. No.: 547,650

[52] U.S. Cl. ..... 242/118.8; 242/118.6

[51] Int. Cl.[2] ..... B65H 75/14

[58] Field of Search..... 242/118.6, 118.61, 118.2, 242/118.8, 118.4, 115, 116

[56] References Cited

UNITED STATES PATENTS

| | | | |
|---|---|---|---|
| 335,692 | 2/1886 | Fries | 242/118.4 |
| 1,565,655 | 12/1925 | Lefebvre | 242/118.8 |
| 2,799,458 | 7/1957 | Nye | 242/118.8 |
| 3,876,073 | 4/1975 | Herbetko | 242/118.8 |

*Primary Examiner*—Edward J. McCarthy
*Attorney, Agent, or Firm*—Max L. Libman

[57] ABSTRACT

A spool or drum for holding flexible linear elements, such as cable, hose or long lengths of extruded plastic, is made up of three flat pieces of corrugated cardboard without glue or staples, one piece being the cylindrical body of the spool which is made by rolling up a cardboard sheet formed with suitable projections spaced along its edges, the other two pieces being disk-shaped with suitable spaced perforations to receive the spaced projections so as to hold the three elements securely together in the form of a spool.

5 Claims, 9 Drawing Figures

FIG. 1.
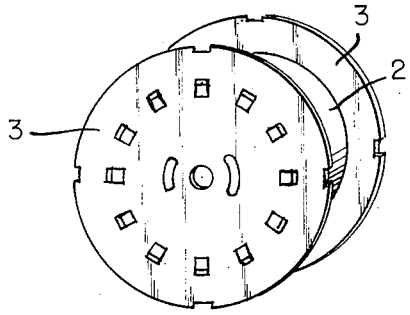
FIG. 2.
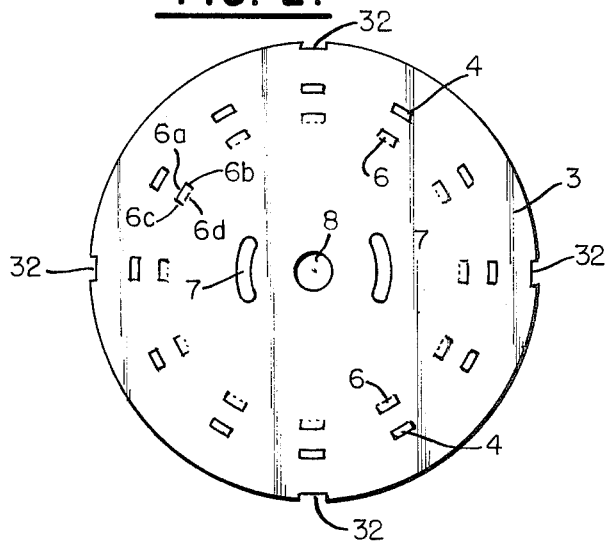
FIG. 3.
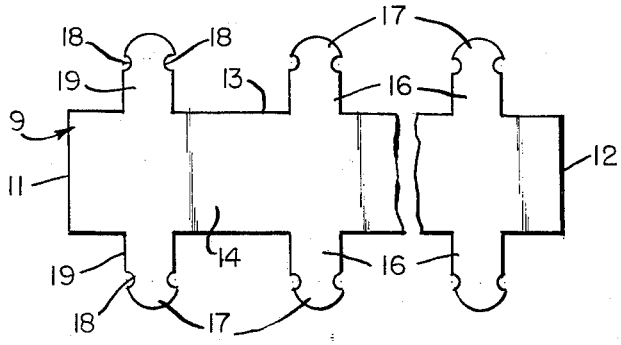
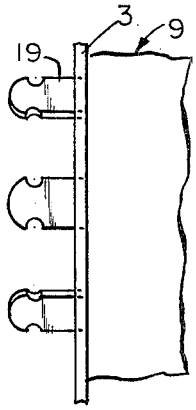
FIG. 4.
FIG. 5.
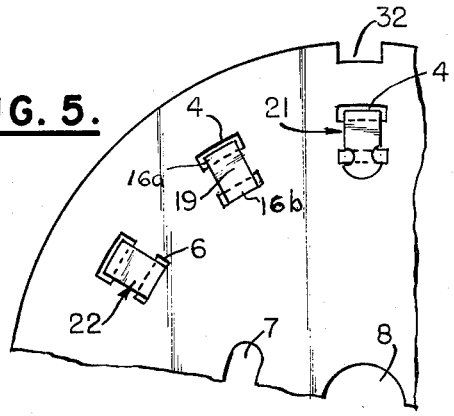

INTERLOCKING CARDBOARD SPOOL ASSEMBLY

Long lengths of flexible material such as hose, cables, and linear pieces of extruded plastic are commonly packaged and shipped by being wound on reels or drums. These are usually in the form of a cylindrical member on which the material is wound, with two disks at the ends of the cylinder for retaining the wound material. The spool is usually made of inexpensive material such as corrugated cardboard, and the three elements, namely, the drum or cylinder and the two end disks, are usually shipped to the user in flat, pre-cut form. The user then assembles them according to his needs, and winds them on the reels for storage and shipment at the end of his fabrication process. The usual method of assembly is by means of adhesives, staples, etc., which require a certain amount of skill, and are also fairly time-consuming. It is an object of the present invention to provide such a spool which can be assembled by unskilled help rapidly and at low cost. According to the invention this is accomplished by so shaping the pieces which comprise the spool that they can be locked by folding tabs on the material through suitable apertures so as to form a firm and rigid spool structure. The manner in which this is done will be shown in more detail below.

In addition, provision is made for, in effect, reducing the diameter of the spool after it has been wound with flexible material. The reason for doing this is that, when winding flexible plastic extrusions on a reel, after the reel is fully wound, the pressure produced by the outer turns of the winding upon the inner turns tends to flatten and distort the soft plastic material. Provision is therefore made of an extra spacer which is wrapped around the reel core in such manner that it is somewhat spaced from the surface of the core, prior to winding the extrusions onto the core, and after the reel has been fully wound, this spacer can be flattened against the reel core to provide more space for the innermost turns, so that the tension on them is therefore relieved and they are prevented from distorting. The manner in which this is done will also be shown in more detail below.

The specific nature of the invention, as well as other objects and advantages thereof, will clearly appear from a description of a preferred embodiment as shown in the accompanying drawings, in which:

FIG. 1 is a perspective view of a spool according to the invention;

FIG. 2 is a side view of one of the disk ends of the spool prior to assembly;

FIG. 3 is a side view of a cylindrical member of the spool in flat condition prior to assembly;

FIG. 4 is a view of a portion of the spool during assembly;

FIG. 5 is a side view of a portion of the assembled spool;

Figure 6:
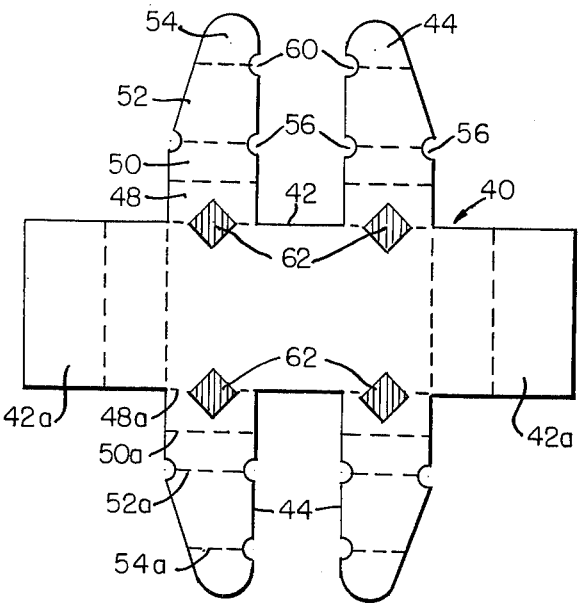
FIG. 6 is a flattened-out view of the spacer unit prior to assembly on the reel.

As shown in FIG. 1, the assembled spool has a central drum in the form of a right cylinder 2, and two end disks 3, attached to the circular ends of the drum for retaining a long length of flexible material for storage, shipping, etc. Such spools are in common use for this purpose, but are generally made by gluing or stapling the three elements together, which is time-consuming and expensive. The drums are usually made of heavy corrugated cardboard, but any sheet material having similar characteristics may be used. The elements of the drum are cut or stamped out of the sheet material and are shipped to the user in flat form, in order to save space in shipping. The personnel of the user then assembles the reels as needed. It will therefore be apparent that reels which can be assembled more rapidly are cheaper for the user, and in addition, if less skill is required, there will also be less waste due to imperfect reel assembly.

FIG. 2 shows one of the disks 3 prior to assembly. It is formed with an outer concentric circle of apertures 4 and an inner concentric circle of slots 6 which are made by cutting through the material as shown at **6*a*, 6*b* and 6*c* to form three sides of the final slot when the disk material is bent inwardly along the fourth side of the slot 6*d*, leaving a strip of the disk material so that when a tab is pushed through the slot, this strip, due to its tendency to return to its original position, engages the side of the tab to help retain it in place. In addition, oval hand holds 7 are cut in the disk a suitable distance from a central thumb hole 8 so that the spool can be easily carried. The central aperture 8** can also receive a pole or rod for winding or unwinding the spool.

FIG. 3 shows the drum or cylinder 9 in the flat condition before it is rolled into its final cylindrical shape. Its length is sufficient so that when it is rolled up with the ends 11 and 12 abutting, it has the desired drum diameter. The sides 13 and 14 carry projecting tabs 16 to that when the sheet 9 is rolled up into a drum, the sides 13 and 14 form the circular ends of the drum, which is now in the form of a right cylinder with the tabs 16 projecting in the generally axial direction of the drum. The spacing of the tabs 16 is made to conform to the circumferential spacing of the apertures 4, and the end disks are now slipped into place with the tabs extending through the apertures 4 as shown in FIG. 4.

Each tab 16 has a rounded end 17 to facilitate putting it through the apertures 4 and slots 6, and just below this rounded end are two side notches 18 formed in the sides 19 of the tabs. These notches are slightly wider than the thickness of the cardboard.

After the tabs 16 are positioned as shown in FIG. 4, the tabs are bent inwardly as shown at **16*a* and the rounded ends are again bent as shown at 16*b* so that they can now be pushed through apertures 4, bending the disk material at 6*d*, with the main body of the tab lying flat along the outer surface of disc 3 as shown in FIG. 5, where one tab is shown at 21 lying flat against the disc but with the end of the tab still straight prior to being bent. At 22, the tab end has been pushed through slot 6 and is in its final position, in which the notches 18 tend to engage the underside of the disk and prevent withdrawal, aided by the strips formed at 6*d***, with is now pushed inwardly as above described. Although the resulting friction fit holds the assembly firmly together, it is easily possible to disassemble the pieces by reversing the process and they can be laid flat to conserve space and can be shipped back or otherwise re-used.

Thus the spool can be readily assembled by hand by unskilled labor, without the use of special tools, glue, staples, etc., as formerly done.

For convenience in shipping, notches 32 are preferably formed in the outer circumference of the disks, to hold tape or string after the spool has been wound with the material it is to carry, or the wound material can be confined in any other way, e.g., by slipping an outer cylinder over the entire wound assembly.

FIGS. 6–9 show an additional feature of the invention which solves a problem that occurs when winding soft plastic extrusions on a reel. When the extrusion has an irregular shape or is hollow, it often becomes distorted after winding on the reel because of the pressure of the outer layers of wound extrusion upon the inner layers. This pressure builds up as the material is wound on the reel since a certain amount of tension must be maintained during the winding operation. Ths construction of FIGS. 6–9 enables this pressure on the inner turns to be relieved by, in effect, reducing the diameter of the reel core after the extrusion has been wound. For this purpose, a spacer 40 is provided having a main body portion 42 of thw same width as the spacing between the reel disks 3, and of sufficient length to at least span the circumferential distance between two adjacent slots 4 with some circumferential overhang as shown at 42*a*. This spacer is preferably of a material similar to that of the reels — corrugated cardboard has been found satisfactory for the purpose.

The main body 42 is provided with at least four tabs 44 spaced to extend through two adjacent slots 4 (FIG. 2). Each tab has four distinct sections 48, 50, 52 and 54 preferably formed by pre-bending the tab along the lines shown as dotted lines 48*a*, 50*a*, 52*a* and 54*a* respectively, so that the tab will easily bend at these lines into the configuration shown in FIG. 7. The spacer is then placed on the reel core 2 which has previously been assembled into its final form as shown in FIGS. 1 and 5; for this use, at least the slots 4 through which the tabs 44 are to be passed are preferably made somewhat larger than usual, since they must also take the thickness of tabs 44 as well as tabs 19 previously described, although if the material used is corrugated cardboard, it is possible to merely make all of the slots a little larger so that they can take either a single or the double thickness satisfactorily, due to the relative softness of this material.

Figure 7:
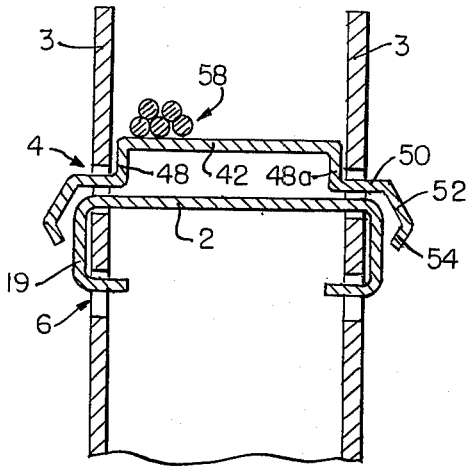
FIG. 7 is a sectional view taken on line 7—7 of FIG. 9.
Figure 9:
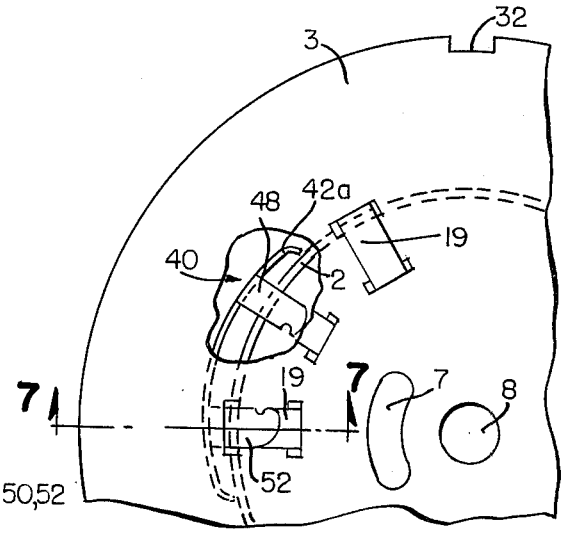
FIG. 9 is a side view of a portion of the assembled spool with the spacer in place shown partly broken away.

With the spacer set on the reel as shown in FIGS. 7 and 9, it will be seen that due to the ledge formed by sections 48 and 50, the main body 42 is spaced away from reel core 2. The spacer is retained in this position by notches 56 which engage the sides of slots 4. The extrusion 58 is then wound on the reel in the usual fashion.

Figure 8:
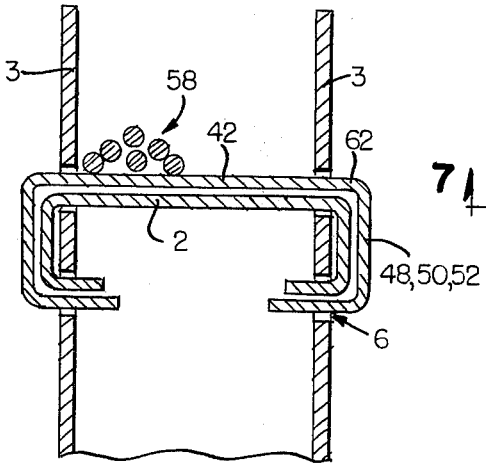
FIG. 8 is a view similar to FIG. 7, but showing a later stage in the assembly after the spacer has been collapsed.

After the reel is fully wound, the tabs 44 are pulled out through the slots 4 as far as they wiill go, thus collapsing the main body 42 so as to lie flat agains the core surface 2 as shown in FIG. 8, thus relieving the pressure on the inner turns of the wound material, which is the desired object. The extra tab length thus formed is then fastened down by pushing the tab ends 52 through the slots 6 where they are held in place by notches 60, so that the wound reel now presents a neat and compact appearance and can be stacked with other reels.

As a further refinement, colored marks 62 can be provided so that they will be visible only when the tab 44 has been completely pulled out, which shows that the spacer has been completely collapsed and that the exposed tab length is sufficient so that the notch 60 will engage the disk 3 when end 54 is inserted into slot 6. This also enables an inspector to ascertain at a glance that the tab has been fully inserted so that it will not later come out of its slot.

It will be apparent that instead of only two tabs 44 on each side of the body portion 42, there could be three or more such tabs so that a greater amount of relief is provided when the tabs are pulled out. However, in practice two such tabs have been found to provide sufficient relief in most cases.

I claim:

1.

a. An interlocked spool of semi-rigid material such as cardboard for carrying flexible linear elements, b. said spool comprising a hollow body member in the form of a right cylinder, and two disk-like side member coaxially fixed to said cylindrical body member at its ends, c. said body member being an originally flat sheet of cardboard rolled up into a hollow cylinder, the circular edges of said cylinder having integral uniformly spaced projections extending in a generally acial direction, d. each said projection being a tab having straight sides and a rounded end, with a side notch on each straight side just below the rounded end, e. each said disk member having an outer concentric circle of perforations dimensioned to receive respective tabs of said cylinder so that the disks are snug against the respective ends of the cylinders with the tabs extending through said perforations, f. each disk member having also an inner concentric circle of slots dimensioned to frictionally receive the rounded ends of said tabs with the main body of each tab bent to lie flat against its disk so that each tab extends outwardly from the cylinder through one of said first perforations and then inwardly back into the cylinder through one of said slots, g. the said side notches of said tabs engaging the disk to deter withdrawal of the tab from its engaged slot, said slots being formed by a shallow U-shaped cut through the disk material with a strip of material remaining attached to the disk at the top of the U so that the disk material is bent inwardly toward the other disk by the rounded tab end and engages the tab end to further deter its withdrawal from the slot.

2. The invention according to claim 1, said disk having a central aperture large enough to receive a human thumb and an oval aperture spaced from said central aperture shaped to receive the fingers of a person handling the spool.

3.

a. An interlocked spool of semi-rigid material such as cardboard for carrying flexible linear elements, b. said spool comprising a hollow body member in the form of a right cylinder, and two disk-like side members coaxially fixed to said cylindrical body member at its ends, c. said body member being an originally flat sheet of cardboard rolled up into a hollow cylinder, the circular edges of said cylinder having integral uniformly spaced projections extending in a generally axial direction, d. each said projection being a tab having straight sides and a rounded end, with a side notch on each straight side just below the rounded end, e. each said disk member having an outer concentric circle of perforations dimensioned to receive respective tabs of said cylinder so that the discks are snug against the respective ends of the cylinders with the tabs extending through said perforations, f. each disk member having also an inner concentric circle of slots dimensioned to frictionally receive the rounded ends of said tabs with the main body of each tab bent to lie flat against its disk so that each tab extends outwardly from the cylinder through one of said first perforations and then inwardly back into the cylinder through one of said slots, g. the said side notches of said tabs engaging the disk to deter withdrawal of the tab from its engaged slot, h. and a collapsible spacer of cardboard comprising i. a main body portion of substantially the same width as the distance between said two disk members and of a greater length than the circumferential distance between two adjacent one of said outer circle of perforations, j. two tabs on each side of said body portion and integral with said body portion and spaced to extend through two adjacent ones of said outer circle of perforations, k. each tab having at least one side notch so spaced that when the tabs are inserted through said outer perforations, the main body is held, by engagement of said notch with the spool disk, spaced above the surface of the hollow cylinder forming the reel core.

4. The invention according to claim 3, l. the projecting portion of each tab having a further notch near its end so spaced that when the tabs are all pulled out through said perforations as far as possible, and the main body thereby collapsed against the cylindrical surface, the end of each tab can be inserted into one of the inner circle of slots until said further notch engages the side of the disk to hold the tab neatly flat against the outer side of the disk.

5. The invention according to claim 4, and a marker imprinted on the exposed surface of each tab near its junction with the main body so as to be visible only when the tab is fully pulled out.

* * * * *